United States Patent [19]

Knoppel

[11] 4,006,494

[45] Feb. 8, 1977

[54] PANTS WITH FRONT POCKET

[76] Inventor: E. Roy Knoppel, 800 SW. 17th St., Boca Raton, Fla. 33432

[22] Filed: Jan. 26, 1976

[21] Appl. No.: 652,619

[52] U.S. Cl. ..... 2/227; 2/247; 2/253; 2/234

[51] Int. Cl.[2] ..... A41D 1/06; A41D 27/20

[58] Field of Search ..... 2/227, 228, 234, 235, 2/247, 250, 253, 211, 221, 67

[56] References Cited

UNITED STATES PATENTS

| | | | |
|---|---|---|---|
| 1,258,591 | 3/1918 | Meyer | 2/247 X |
| 1,827,585 | 10/1931 | Kautz | 2/227 X |
| 2,521,410 | 9/1950 | Rosen | 2/227 |
| 2,702,545 | 2/1955 | Orr | 2/227 X |
| 3,137,862 | 6/1964 | Mizerak | 2/67 X |

*Primary Examiner*—H. Hampton Hunter
*Attorney, Agent, or Firm*—Oltman and Flynn

[57] ABSTRACT

A pair of dress pants or slacks has a wide and deep pocket across the front between the center creases on the legs. The pocket has a top opening with a slide opening and a lower end flap that is not attached directly to the front of the pants or slacks. On men's pants this flap covers an opening in the front of the pants just above the crotch.

5 Claims, 4 Drawing Figures

PANTS WITH FRONT POCKET

BACKGROUND OF THE INVENTION

Dress pants or slacks worn today by both men and women often do not have adequate and convenient pockets. In women's slacks usually there is no pocket at all or only small, tight pockets in front, in order to achieve a slender appearance of the wearer. In men's pants or slacks the front pockets today usually are so tight that the wearer cannot easily remove the usual everyday articles, such as keys or coins, from his front pockets. Such inconvenient front pockets can be particularly troublesome to the driver of a car on a toll road because of the difficulty of removing coins or a wallet from his or her front pocket (if any) while sitting in the driver's seat.

Various proposals have been made heretofore for front pockets on overalls (e.g., U.S. Pat. No. 1,354,289 to Feige, U.S. Pat. No. 1,389,664 to Jackson, U.S. Pat. No. 1,764,483 to Watkins, and U.S. Pat. No. 815,063 to Brigham). Also, it has been proposed to provide a front pocket on men's undershorts (U.S. Pat. No. 3,137,862 to Mizerak), on women's skirts (U.S. Pat. No. 573,650 to Hass), and on the fly of trousers (U.S. Pat. No. 2,498,048 to Neinken).

None of these prior patents was directed toward improving the practical utility of dress pants or slacks while retaining a reasonably trim, attractive appearance.

SUMMARY OF THE INVENTION

The present invention provides on a pair of pants or slacks a wide, deep, readily accessible pocket in front that is capable of holding such everyday articles as a wallet, credit card holder, coins, keys, and the like. Preferably, the front pocket in accordance with the present invention extends from side to side from the top of the usual crease in one leg to the top of the other leg crease. The pocket preferably has a top opening which extends across the full width of the pocket and has a manually operable closure, such as a slide fastener or the like. The pocket preferably is stitched to the front of the pants or slacks completely across the top of the pocket and down each side more than halfway down the pocket. The lower end of the pocket has a flap that is not stitched or otherwise attached to the front of the pants or slacks. In the case of men's pants the front of the pants has a central opening located behind this flap and normally concealed by it so that a slide fastener for this opening is not required. The lower end flap of the pocket may be folded up to make this opening accessible.

A principal object of this invention is to provide in a pair of pants or slacks a novel front pocket arrangement capable of holding various articles, such as money, keys, wallets, and credit card holders, which combines maximum security for these articles and easy access to them by the wearer.

Another object of this invention is to provide in a pair of pants or slacks such a novel front pocket arrangement which does not detract from the appearance of the garment and obviates the need for a slide fastener at the fly on men's pants.

Further objects and advantages of this invention will be apparent from the following detailed description of a presently-preferred embodiment thereof, which is shown in the accompanying drawing in which.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

Figure 1:
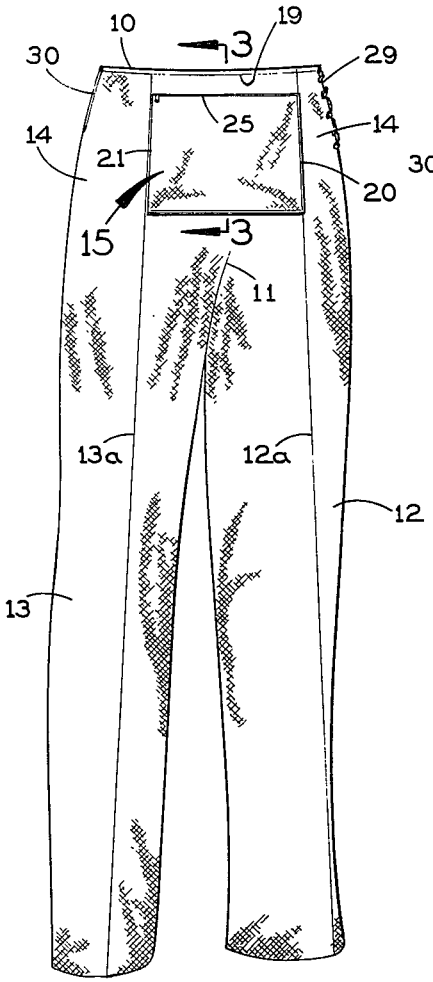
FIG. 1 is a front perspective view of a pair of men's dress pants or slacks embodying the novel front pocket arrangement of the present invention.

As shown in FIG. 1, the pair of pants or slacks has a waistband 10 at the top, a crotch 11 spaced below the waistband, and left and right legs 12 and 13 extending down past the crotch and having respective central creases **12*a* and 13*a* along their length. The pants have a front panel 14 extending from one side to the opposite side between the waistband 10 and the crotch 11.**

Figure 2:
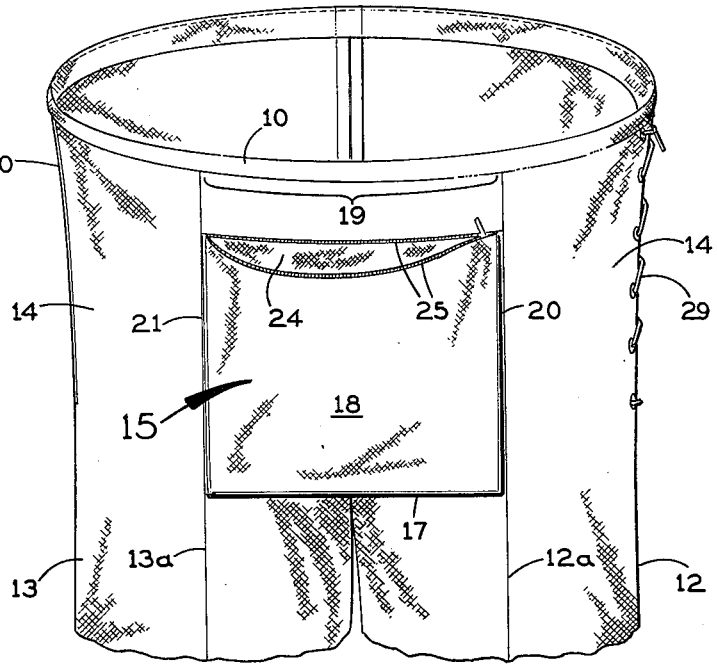
FIG. 2 is a fragmentary front view on a larger scale showing the front pocket with its slide fastener near the top open.
Figure 3:
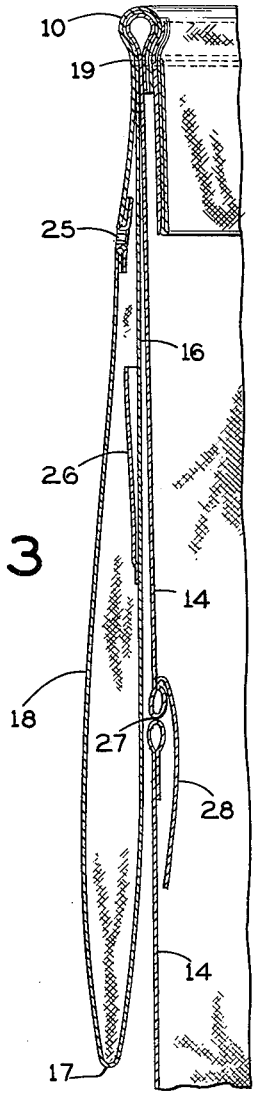
FIG. 3 is a vertical cross-section taken along the line 3—3 in FIG. 2 through the front pocket.

In accordance with the present invention, a wide and deep front pocket 15 is provided in front of the front panel 14. In the particular embodiment shown, this front pocket extends from side to side between the upper end of one leg crease **12*a* and the upper end of the other leg crease 13*a*. As shown in FIG. 3, this front pocket has a back panel 16 extending in front of the front panel 14 of the pants between the pleats 12*a* and 13*a*. At the lower end of the back panel 16 a horizontal fold 17 connects it to a front panel 18 of the pocket, which extends up in front of the back panel 16 for their complete height and width. Preferably, the back panel 16, the bottom fold 17 and the front panel 18 on the pocket are provided by a single piece of fabric. The upper ends of the back and front panels 16 and 18 of the pocket are stitched to the front panel 14 of the pants along a horizontal line of stitches at 19, which extends across the complete width of the pocket just below the waistband 10, as shown in FIG. 2. Also, both the back and front panels 16 and 18 of the pocket are stitched to the front panel 14 of the pants along vertical stitch lines 20 and 21 (FIG. 4) aligned with the respective leg crease 12*a* and 13*a*** and each extending down from the top of the pocket for about 60% of its vertical depth down along the front of the pants.

Figure 4:
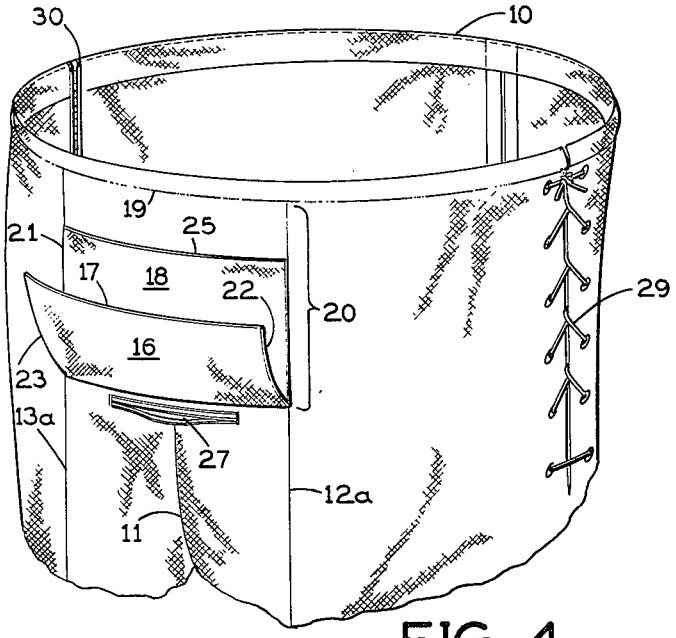
FIG. 4 is a fragmentary front perspective view showing the lower end of the front pocket folded up to expose an opening provided in the front of the pants for micturition purposes.

As shown in FIG. 4, the back and front panels 16 and 18 of the pocket are stitched or otherwise joined directly to each other at 22 and 23 below the side stitches 20 and 21. Throughout its extent from side to side below the side stitches 20 and 21, the lower end of the pocket is separate and disconnected from the front panel 14 of the pants, so that it provides a flexible flap that normally hangs down vertically but may be folded up, as shown in FIG. 4, in front of the upper portion of the pocket. Preferably, this lower end flap of the pocket takes up about 40% of its vertical depth.

A short distance (such as 1½ inches or so) below its top stitch line 19, the front panel 18 of the pocket has a horizontal opening 24 (FIG. 2) extending across its complete width between the side stitches 20 and 21. This opening is normally closed by a slide fastener 25 or other manually operated, releasable fastener appropriate for garments.

The back panel 16 of the pocket carries one or more relatively shallow inner pockets 26 (FIG. 3) on the inside a short distance below the top opening 25 for holding coins, keys or similar small articles.

The front panel 14 of the pants has an opening 27, for convenience of micturition, which is located behind the foldable lower end flap of the pocket. In the particular embodiment shown, this opening 27 is horizontally elongated and it is positioned a short distance below the horizontal level of the lower ends of the side stitches 20 and 21 which attach the pocket to the front panel 14 of the pants. Also, the opening 27 extends symmetrically on opposite sides of the crotch. However, it is to be understood that this opening may have a location different from the location shown, and it may be elongated vertically or diagonally, rather than horizontally. As shown in FIG. 4, the front panel 14 of the pants carries a flexible fabric flap 28 which hangs down behind the opening 27 and may be lifted or folded to one side or the other when necessary.

In the embodiment illustrated, the pants have adjustable lacing 29 along the left side and a zipper 30 along the right side, both extending down from the waistband 10 for a distance of 8 inches or so, to facilitate putting the pants on or taking them off. However, it is to be understood that any other appropriate arrangement for this same purpose may be provided, such as a slide fastener at the back.

In the case of women's slacks, the construction may be essentially similar to the one shown except that the opening 27 will be omitted.

The location of the front pocket 15 and its top closure 25 provide improved security against pickpockets. Also, the location, width and depth of the front pocket make it very convenient and accessible for holding money, credit cards, keys and other small valuables, even when the wearer is sitting down, such as in a car. The provision of the lower end flap on the pocket avoids any binding tendency across the wearer's front when he or she is sitting down. On men's pants this flap makes it unnecessary to provide the usual slide fastener fly, which can be a source of embarrassment if the wearer forgets to close it or if it fails to close properly and a source of possible injury to the wearer.

I claim:

1. In a pair of pants or slacks having a waistband at the top, a crotch spaced below the waistband, a front panel between the waistband and the crotch, and a pair of legs, the improvement which comprises:

a front pocket joined directly to said front panel and extending from side to side across the front thereof for at least substantially the width of the pants between the respective centerlines of its legs;

said pocket having a back panel and a front panel which are joined to each other and disconnected from said front panel of the pants at the lower edge and along the opposite side edges up from said lower edge of the pocket, whereby to provide a flap at the lower end of the pocket that is foldable up in front of the upper portion of the pocket;

said pocket having a substantially horizontal top opening extending from side to side across substantially the full width of the pocket, and a slide fastener extending across said top opening;

said front and back panels of the pocket being stitched at their upper ends to said front panel of the pants;

said top opening in the pocket being spaced below the stitched upper end of said front and back panels of the pocket;

and said front and back panels of the pocket being stitched to said front panel of the pants down along the opposite side edges of the pocket from the upper end of said front and back panels of the pocket to a location more than half-way down the pocket.

2. A pair of pants or slacks according to claim 1, and further comprising a smaller inner pocket joined to said back panel of the first-mentioned pocket at the front thereof, said inner pocket being disposed completely inside said first-mentioned pocket and being open at the top.

3. In a pair of pants or slacks having a waistband at the top, a crotch spaced below the waistband, a front panel between the waistband and the crotch, and a pair of legs, the improvement which comprises:

a front pocket joined directly to said front panel and extending from side to side across the front thereof for at least substantially the width of the pants between the respective centerlines of its legs;

said pocket having a back panel and a front panel which are joined to each other and disconnected from said front panel of the pants at the lower edge and along the opposite side edges up from said lower edge of the pocket, whereby to provide a flat at the lower end of the pocket that is foldable up in front of the upper portion of the pocket;

said pocket having an opening at the front;

and said front and back panels of the pocket being stitched to said front panel of the pants across the top of the pocket above said opening and down along each side edge of the pocket below said opening.

4. In a pair of pants or slacks having a waistband at the top, the improvement which comprises:

a front pocket attached to the front of the pants between the waistband and the crotch and extending substantially the full distance between the centerlines of the respective legs, said pocket having an opening at the top which is spaced below said waistband, said pocket being joined directly to the front of the pants along each side edge of the pocket, and said pocket at its lower end being disconnected from the front of the pants and presenting a flexible flap that is foldable up in front of the upper portion of the pocket.

5. A pair of pants or slacks according to claim 4, wherein the front of the pants has a central opening just above the crotch behind said flap and normally covered by the latter.

* * * * *